United States Patent [19]

Greer

[11] Patent Number: 4,725,094

[45] Date of Patent: Feb. 16, 1988

[54] EXPANDABLE TERRY CLOTH SAND OR LAWN CHAIR COVER HAVING INTEGRALLY FORMED POCKETS

[76] Inventor: Stephen I. Greer, 1209 N. State Pkwy., Apartment 7, Chicago, Ill. 60610

[21] Appl. No.: 60,129

[22] Filed: Jun. 9, 1987

Related U.S. Application Data

[63] Continuation-in-part of Ser. No. 759,229, Jul. 26, 1985.

[51] Int. Cl.[4] ..... A47C 31/10

[52] U.S. Cl. ..... 297/229; 297/191; 297/220

[58] Field of Search ..... 297/229, 219, 224, 457, 297/191, 220; 5/485, 496, 499, 497

[56] References Cited

U.S. PATENT DOCUMENTS

| | | | |
|---|---|---|---|
| 2,817,391 | 12/1957 | Zacks | 297/229 |
| 4,165,125 | 8/1979 | Owen | 297/220 |
| 4,273,380 | 6/1981 | Silvestri | 297/229 X |
| 4,536,028 | 8/1985 | Jones et al. | 297/224 |
| 4,597,605 | 7/1986 | Gilbert | 297/219 |
| 4,666,207 | 5/1987 | Quartano | 297/229 |
| 4,671,568 | 6/1987 | Greer | 297/229 |
| 4,676,548 | 6/1987 | Bradbury | 297/191 X |

*Primary Examiner*—Peter A. Aschenbrenner
*Attorney, Agent, or Firm*—Milton S. Gerstein; Marvin N. Benn

[57] ABSTRACT

A towel or cover for covering a lawn chair or sand chair, which cover has a kangaroo-type pocket provided in the head or upper portion of the cover. The kangaroo-type pocket is positionable in one of two positions, one being in front of the chair for forming therein a pillow by providing clothing or other soft material in the pocket, and the other being positionable in the rear of the chair for storing other articles and the like therein. The head portion of the towel includes a hood-type member for telescopingly receiving therein the top portion of the chair which it covers. The hood portion is also defined by a pair of stretchable rectangular-shaped gussets to allow the hood portion to stretchably fit over any type and size of chair. In the first version of the cover, the intermediate portion thereof is provided with a first and second pair of loops for use in retaining the intermediate portion of the cover to the sand chair, a first pair of loops being used for a first kind of sand chair, and both pairs of loops being used for a second kind of sand chair. In the second embodiment of the invention, the towel or cover is used for covering a chaise lounge, which cover is also provided with peripheral elasic band provided in the hemmed peripheral border of the cover. In the second embodiment, there is also provided a retaining band for holding the cover on the lounge. This retaining band is provided on the undersurface of the cover, and is fixed between the two side edge surfaces of the cover. Each end of the stretchable band is provided with a pair of spaced-apart buttons for coöperating with a respective loop fixed to a side edge of the cover directly juxtapositioned next to the respective pair of loops, wherby the tension on the retaining band may be varied by inserting one or the other of the pair of buttons through the respective loop adjacent the pair of buttons.

16 Claims, 20 Drawing Figures

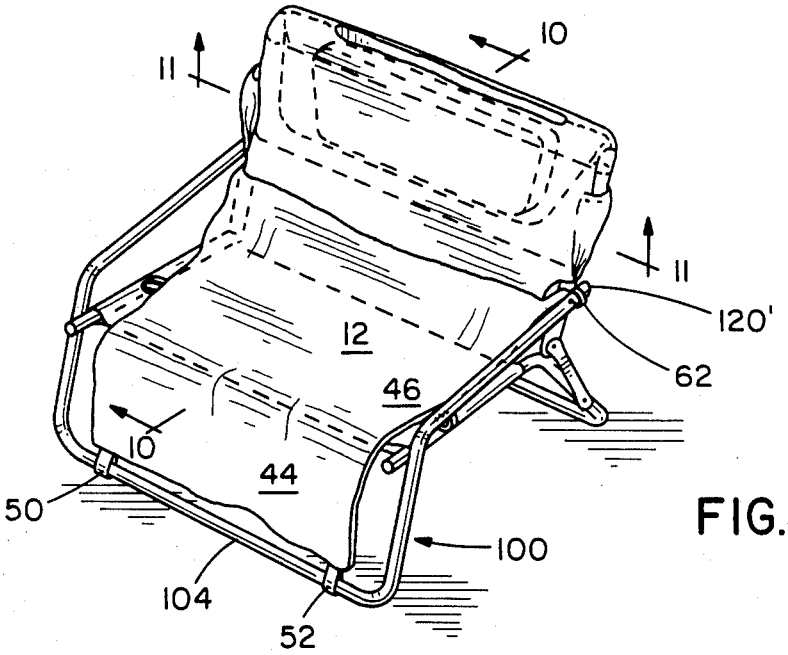
FIG. 8
FIG. 9
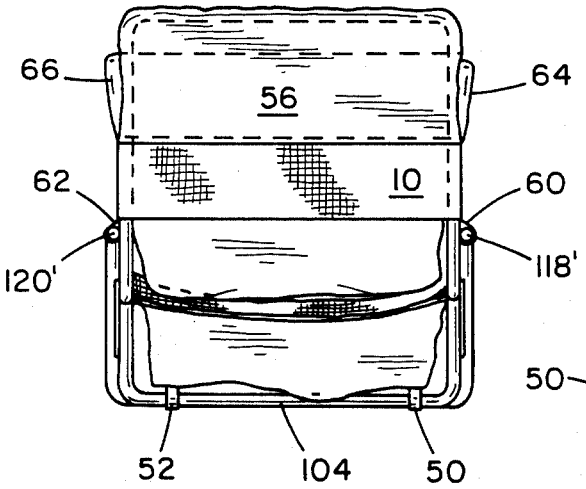
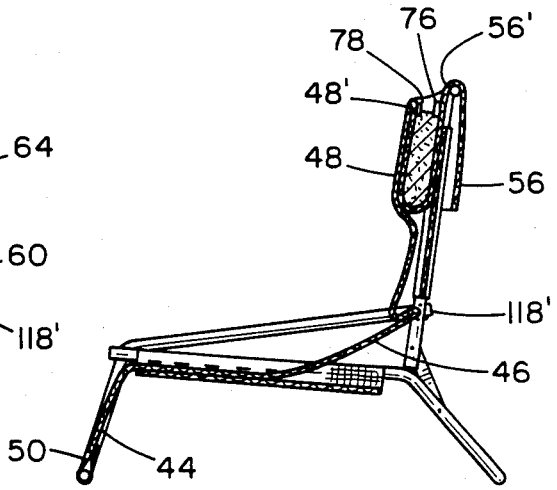
FIG. 10
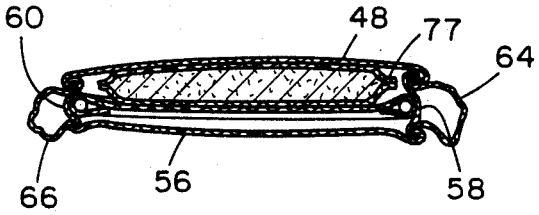
FIG. 11
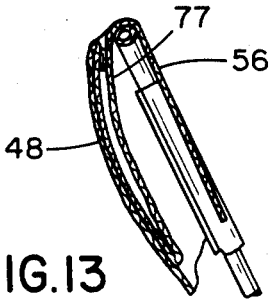
FIG. 13
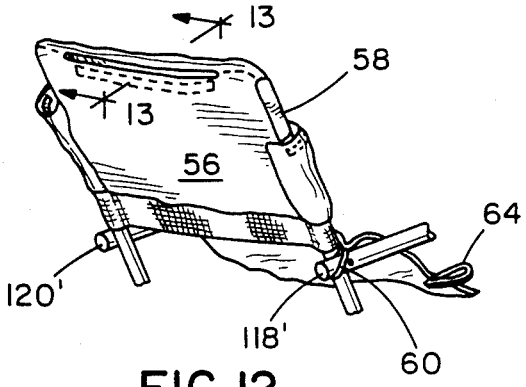
FIG. 12

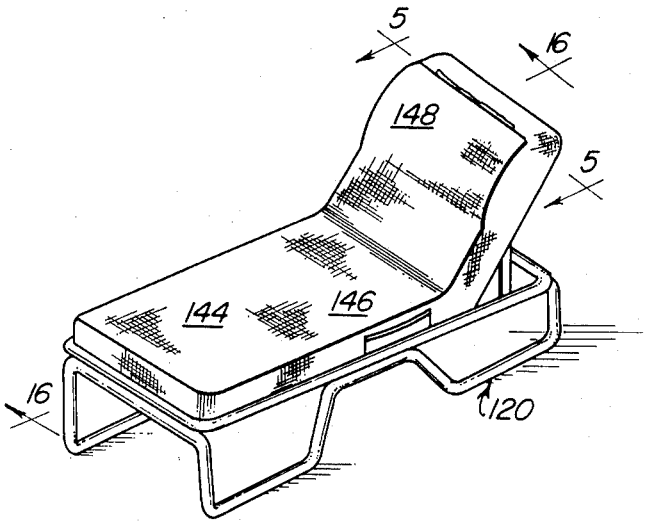
FIG. 14
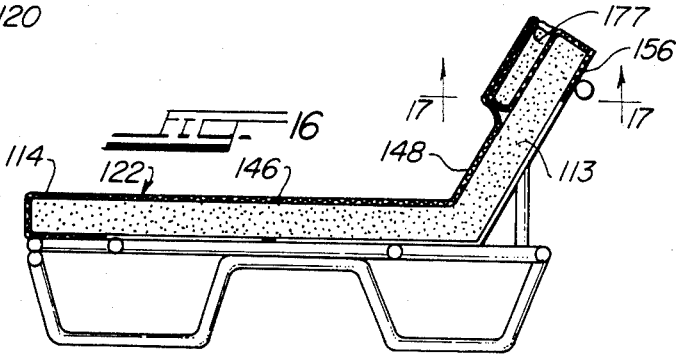
FIG. 16
FIG. 15
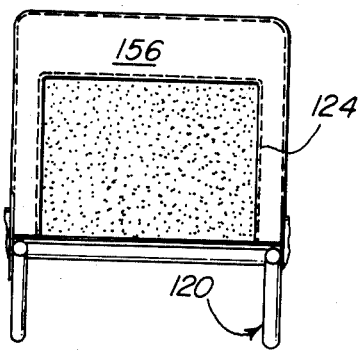
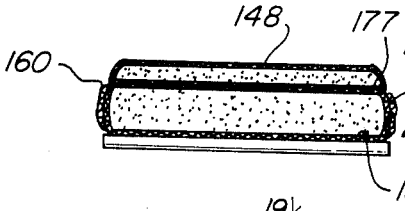
FIG. 17
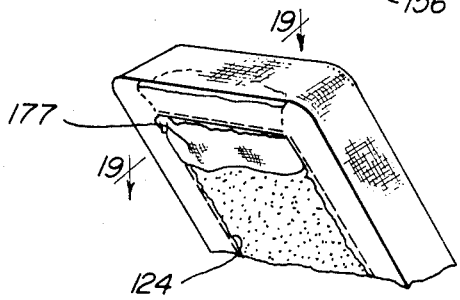
FIG. 18
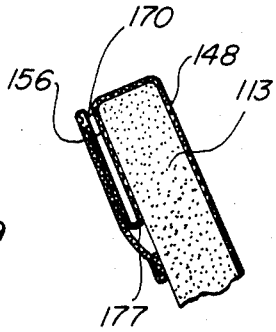
FIG. 19
FIG. 20
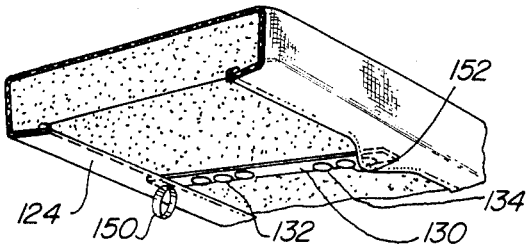

EXPANDABLE TERRY CLOTH SAND OR LAWN CHAIR COVER HAVING INTEGRALLY FORMED POCKETS

CROSS-REFERENCE TO RELATED APPLICATION

The present application is a continuation-in-part application of application Ser. No. 759,229, filed July 26, 1985, by the same applicant, Stephen I. Greer.

BACKGROUND OF THE INVENTION

The present invention is directed to a terry cloth towel for covering a lawn chair, a sand chair or the like, in order to provide added comfort, as well as to protect the exposed skin of the person sitting or reclining in the chair from excessive heat retained by the chair from the sun. Lawn chair and sand chair covers are well known and have been used in order to provide protection against the chair's heat, as well as to provide dryness and comfort to the person sitting in the chair. The present invention is directed to such a cover or towel, which incorporates therein a kangaroo-type pocket or pouch at the top or head portion of the cover, for storing articles therein and for providing a pocket which may be filled in order to provide a pillow-like structure for the person's head. Examples of prior art covers are disclosed in the following patents: U.S. Pat. Nos. 4,536,028 and 4,553,785. None of these patents discloses a towel for use with a sand chair, or a towel for covering any kind of chair which incorporates a kangaroo-type pouch or pocket.

SUMMARY OF THE INVENTION

It is, therefore, the primary objective of the present invention to provide a towel for covering a lawn or sand chair, or the like, which towel includes a reclosable kangaroo-type pouch or pocket formed in the upper or head portion of the cover by which articles may be stored therein, which pocket may be filled to form a pillow upon which a person may rest his head.

It is another objective of the present invention to provide such a cover for a lawn or sand chair, which cover is provided with a pair of side pockets in the head portion, and which head portion also includes a hood or telescoping member to be slipped over the top of the chair to be covered.

It is another objective of the present invention to provide such a cover for a lawn or sand chair, which cover includes a pair of stretchable, rectangular-shaped gussets forming part of the sides of the head portion to allow for expansion of the head portion of the cover to fit any size lawn or sand chair, and to allow for easy placement of the towel onto the chair.

It is yet another objective of the present invention to provide a towel or cover having a reclosable kangaroo-type pouch or pocket in which the kangaroo-type pouch or pocket may be positioned in either one of two positions: A first position against the interior surface of the head of the chair, against which a person rests his head, so that the kangaroo-type pouch or pocket may be used as a pillow by stuffing suitably soft material therein; and a second position against the outside or exterior surface of the head of the chair, in which a variety of articles may be stored therein.

It is still another objective of the present invention to allow for the towel or cover to be used to cover any type and size of sand chair, such that the covering is firmly yet releasably attached to the chair itself, with appropriate securing means provided on the towel or cover in order to fit any type chair being manufactured today.

BRIEF DESCRIPTION OF THE DRAWINGS

The invention will be more readily understood with reference to the accompanying drawings, wherein:

FIG. 8 is a perspective view showing a second type of sand chair covered by the cover of the invention;

FIG. 9 is a rear view of the embodiment of FIG. 8;

FIG. 10 is a cross-sectional view taken along line 10—10 of FIG. 8;

FIG. 11 is a cross-sectional view taken along line 11—11 of FIG. 8;

FIG. 12 is a partial perspective view of the rear portion of the chair covered with the cover of the invention shown in FIG. 8;

FIG. 13 is a cross-sectional view taken along line 13—13 of FIG. 12;

FIG. 14 is a perspective view of a lounge chair being covered by the second embodiment of the cover of the invention;

FIG. 15 is a rear view of the covered lounge chair of FIG. 14;

FIG. 16 is a cross-sectional view taken along line 16—16 of FIG. 14;

FIG. 17 is a cross-sectional view taken along line 17—17 of FIG. 16;

FIG. 18 is a partial bottom perspective view of the covered lounge chair of FIG. 17;

FIG. 19 is a cross-sectional view taken along line 19—19 of FIG. 18; and FIG. 20 is a partial bottom perspective view showing the stretchable retaining band with a plurality of button elements thereon for retaining the cover of the invention in place on the lounge chair of FIG. 14.

DETAILED DESCRIPTION OF THE DRAWINGS

Figure 1:
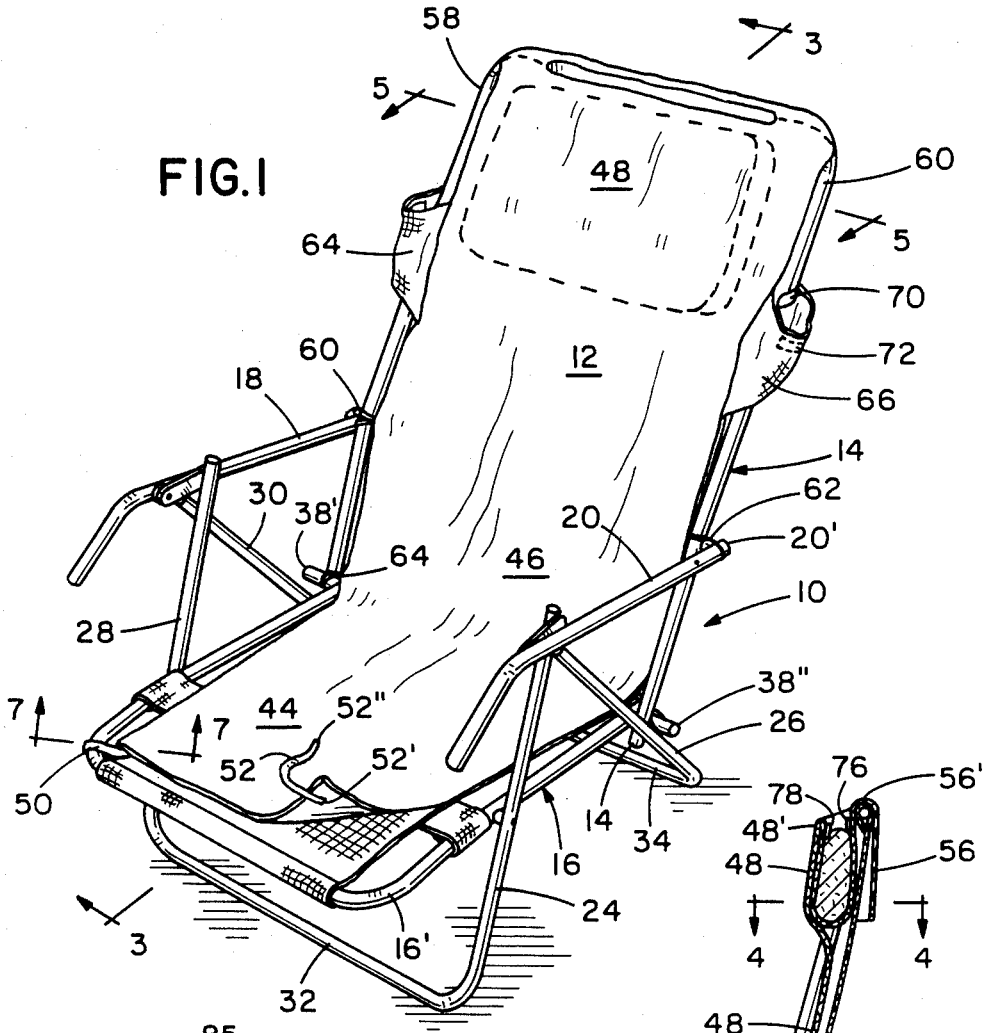
FIG. 1 is a perspective view showing a first embodiment of the cover of the invention for covering a first type of sand chair.

Referring now to the drawings in greater detail, the two basic embodiments of the invention are shown. The first embodiment of the cover of the invention is shown in FIGS. 1 through 13, and the second embodiment of the cover of the invention is shown in FIGS. 14 through 20. The first embodiment is used for covering a sand chair and the like, while the second embodiment is used for covering a lounge chair or the like.

Referring now to FIGS. 1 through 7, there is shown in FIG. 1 a conventional sand chair 10 covered by the towel or cover 12 of the present invention. The lounge chair 10 generally includes frame means including a vertically-oriented frame 14, which mounts the backrest of the chair, and a horizontally-disposed frame 16 upon which is provided the seat of the chair. The frames 14 and 16 are generally constructed of aluminum tubing or the like. A pair of armrests 18 and 20 are also provided, and are fixedly connected to respective portions of the vertically-oriented frame 14, as clearly shown in FIG. 1. The chair 10 also includes upstanding support structure defined by tubular elements 24, 26, 28, 30, as well as horizontally-disposed support tubes 32 and 34. The tubular frame is collapsible in the well known manner, by suitably pivotally interconnecting the tubular elements. Each of the armrests 18 and 20 is provided with rearward-most portions 18', 20' which extend rearwardly of the vertical frame 14, as clearly shown in FIGS. 1 and 3. The horizontal frame 16 includes a rear, horizontal tubular element 38 extending the full width of the chair, and which also defines a pair of end portions 38', 38", each of which extend outwardly beyond the respective vertical tubular elements of the vertically-oriented frame 14, as clearly shown in FIGS. 1 and 2. The projecting portions 18', 20', 38' and 38" provide anchoring points for fastening loops of the towel or cover of the invention, to be described below in greater detail.

Figure 7:
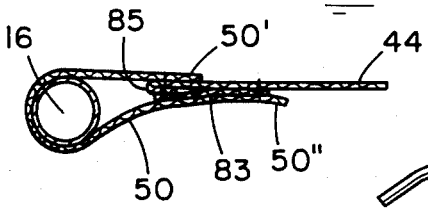
FIG. 7 is a cross-sectional view taken along line 7—7 of FIG. 1.

The towel 12 consists of a first lower portion 44, an intermediate portion 46, and an upper head portion 48. The lower portion 44 is provided with a pair of straps 50 and 52, with each strap 50, 52 having a first end fixedly attached to the under or interior surface of the towel or cover, as indicated by reference numeral 52' in FIG. 1. The other end of each of the straps 50 and 52, such as end 52", is provided with half of a reclosable fastener, such as the pile or hook portion of the hook and pile fastener. A interior undersurface of the end portion of the towel or cover 12 is also provided with the other mating half of the hook and pile fastener, preferably adjacent to the fixed end 52', so that each of the straps 50 and 52 may be looped around the tubular element 16' of the horizontal frame 16 of the chair, and held thereon by removably connecting the half of the fastening element of the end 52' to the other half of the fastening element provided on the interior surface of the towel or cover, as best seen in FIG. 7.

The intermediate portion 46 of the towel or cover 12 is provided with a pair of loop elements. The first pair of loop elements include loops 60, 62 for looping over the rearwardly projecting end portions 18', 20', while the second pair of loop elements includes loops 64 and 66 for looping over the laterally projecting end portions 38' and 38", whereby the loops adequately retain the intermediate portion of the towel in place on the chair, and thereby prevents slippage and accidental removal of the cover. These loops 60, 62, 64, and 66 are preferably made of elastic material to provide the stretching thereof to allow for easy connection of these loops to the appropriately-projecting portions of the chair's frame. It is also to be noted that the loops 64 and 66 may, alternatively, be looped around the lower projecting end portions 14' and 14" of the vertically-oriented frame member 14, as long as it may be held therein without the likelihood of gravity causing the loops to fall downward.

Figure 3:
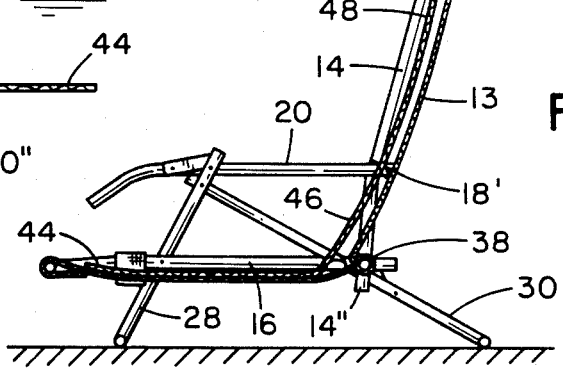
FIG. 3 is a cross-sectional view taken along line 3—3 of FIG. 1.
Figure 2:
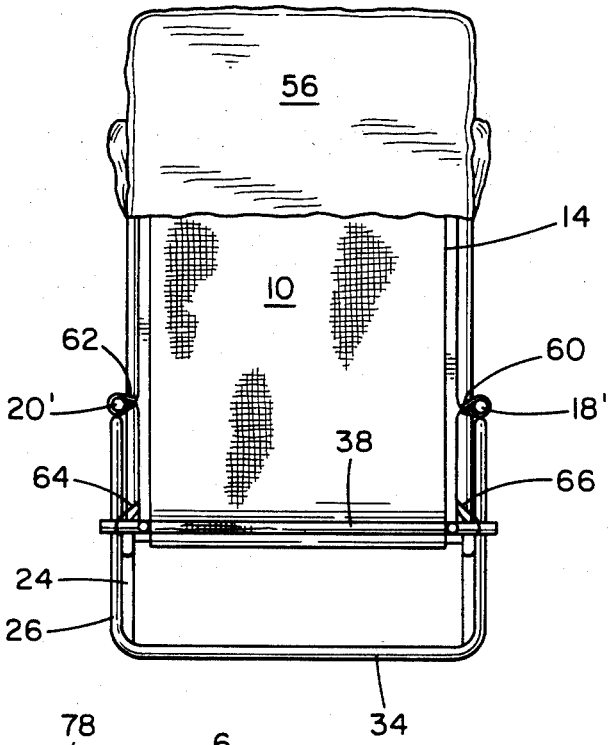
FIG. 2 is the rear view thereof.
Figure 5:
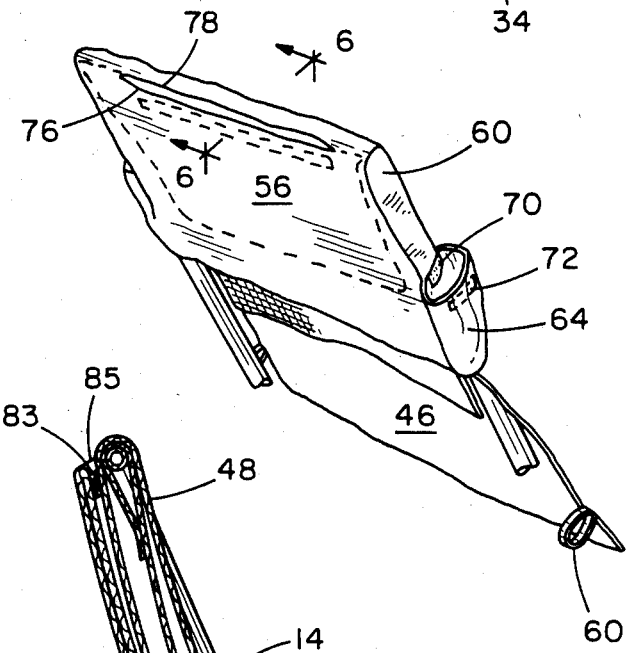
FIG. 5 is a partial perspective view of the rear portion of the chair with the cover of the invention shown in FIG. 1.
Figure 6:
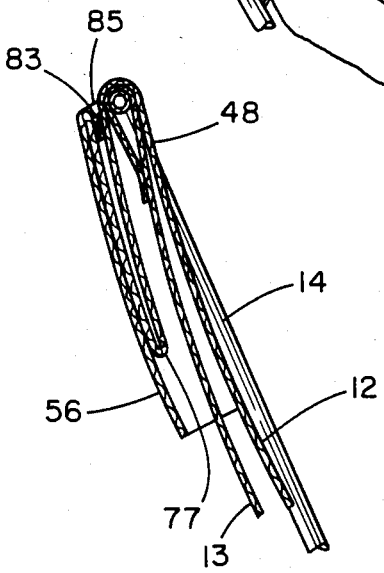
FIG. 6 is a cross-sectional view taken along line 6—6 of FIG. 5.

The upper portion 48 of the towel 12 has associated with it a hood member which allows for the draping of the upper portion of the towel over the upper portion of the backrest of the chair. Referring to FIGS. 1, 2 and 3, this hood member is defined by a rear surface layer of material 56 that is connected to the upper head portion 48 of the towel 12 by a pair of side surfaces or walls 58 and 60. These side surfaces 58 and 60 interconnect respectively and oppositely-disposed side edges of the upper head portion 48 of the towel and the rear surface layer 56. Each of the side surfaces 58 and 60 is preferably made of stretchable nylon fabric so as to allow for the variable positioning of the upper body portion 48 relative to the rear surface layer 56, in order to accommodate various sizes of vertically-oriented frames 14 of sand chairs or the like. Furthermore, the stretchable side surfaces 58 and 60 allow for quick and easy placement of the hood over the upper sections of the vertically-oriented frame 14 of the chair. Also associated with each of these side surfaces 58 and 60 are a pair of reclosable side pockets 64 and 66, each side pocket 64 and 66 being suitably stitchably connected with the side edges of the upper head portion 48 and the rear surface layer 56. Each pocket 64 and 66 defines interior volume in which might be placed sunglasses, cigarettes, sun tan lotion, etc. for safe storage. In the preferred embodiment, each of the pockets 64 and 66 extends substantially along the entire length of the respective side wall or side surfaces 58 and 60, to thereby substantially cover a considerable portion thereof from view. Each of the pockets is preferably reclosable by cooperating hook and pile fasteners, a strip of the hook portion thereof being provided on the respective side surface 58, 60, while the pile portion thereof being affixed to the upper interior surface of a pocket to thereby provide an easy reclosable pocket. These reclosable hook and pile fasteners are indicated generally by reference numeral 70 and 72 in FIG. 1.

The hood member is also provided with a kangaroo-type pocket or pouch, which pouch is provided between the rear surface layer 56 and the upper head portion 48. This kangaroo-type pouch may be better seen with reference to FIGS. 3, 4 and 6. The pouch or pocket is formed by a single piece of fabric having a first upper edge 76 and a second upper edge 78. The first upper edge 76 is integrally connected to the upper edge 56' of the rear surface layer 56. In practice, the rear surface layer 56 and the kangaroo-type pocket 77 may be formed from one piece of material. The other upper edge 78 is also suitably connected or stitched to the upper edge 48' of the upper body portion 48 of the towel. Again, the rear surface layer 56, the pocket 77, and the upper body portion 48, as well as the entire towel 12 and 14 may all be formed from one single piece of material, such as terry cloth, to obviate any subsequent stitching of the portions of the various portions described.

Figure 4:
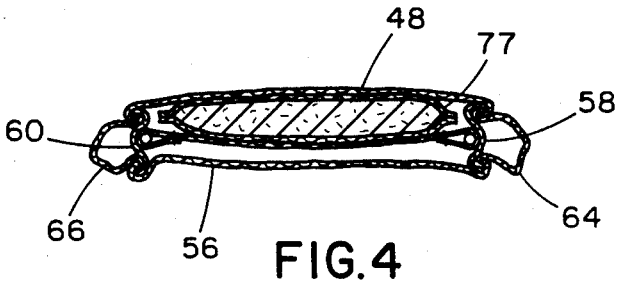
FIG. 4 is a cross-sectional view taken along line 4—4 of FIG. 3.

The pocket 77 is connected to the upper head portion 48 and the rear surface layer 56 only along its upper edges 76 and 78, with the remainder of the side surfaces of the pocket 77 being allowed to hang freely downward between these two sandwiching layers, in order to provide a repositionable kangaroo-type pocket or pouch 77. Thus, the kangaroo-type pocket 77 may take on two different states or positions: A first state thereof wherein the pocket 77 is positioned interiorly of the back frame 13 of the chair 10, in the manner shown in FIG. 3; or exteriorly of the back frame 13, whereby the pocket overhangs rearwardly of the chair, in the manner shown in FIG. 6. As shown in FIGS. 3 and 4, when in the first state or position thereof, the pocket 77 may be stuffed with a person's clothing removed during sun bathing or the like, or other soft material may be stuffed into the pocket whereby a pillow-type structure is formed, against which the chair's user may rest his head in comfort. When the pocket 77 is positioned in its second state exteriorly and rearwardly of the chair, any type of article may be stored therein for safekeeping or the like.

The kangaroo-type pouch or pocket 77 is also preferably reclosable by the provision of a hook and pile fastener. A strip constituting the hook portion of the hook and pile fastener is attached to the upper interior surface of the upper edge 76 of the pocket 77, while the mating strip of pile fabric is secured to the inner surface of the upper edge 78, to thereby provide a reclosable kangaroo-type pocket.

FIGS. 8 through 13 disclose the same type of cover 12 as shown in FIGS. 1 through 7, but covering a chair 100 having a different construction than that of the chair 10, as shown in FIG. 1. The basic difference between the chair 100 and the chair 10 is that the chair 100 is not provided with the lower-projecting end portions 38' and 38" over which are looped the loops 64 and 66. For the chair 100, the towel 12 would be connected at its intermediate portion 46 thereof only by the loops 60 and 62, with the loops 64 and 66 hanging free and not in use. The towel 12 is exactly the same as that disclosed in FIGS. 1 through 7, with the loops about 60 and 62 being looped the rearwardly extending and projecting end portions 118' and 120'. In this version, the lower end portion 44 of the cover or towel 12 overhangs the front of the chair, as shown in FIG. 8, with the securing straps 50 and 52 being looped about the lower horizontal floor-supporting tubular element 104 of the chair 100.

FIGS. 14 through 20 disclose a second embodiment of the towel or cover of the present invention, for use with a lounge chair. A lounge chair 120 having a mattress thereon is covered by the cover of the present invention, which cover 122 includes a hemmed peripheral edge 124 provided with an elastic band extending completely around the border of the cover 122, within the hemmed peripheral edge 124, in order to securely hold the cover or towel 122 in place on the mattress of the chair. The towel 122 is provided with the kangaroo-type pocket 177 in the upper head portion thereof, and the rear surface layer 156 to define therebetween a hood for slipping over the upper edge portion of the mattress. The towel 122 is also provided with a pair of side walls or surfaces 150 and 166 which, in this embodiment, need not be made of stretchable fabric, but may be made of the same terry cloth material as the rest of the towel or cover. The cover 122 also has an upper head portion 148, intermediate portion 146, and a lower portion 144. For securing the intermediate portion of the towel 122 to the mattress 113 of the lounge chair 120, there is provided at least one stretchable elastic securing band 130, as seen in FIG. 20. This band 130 has both of its ends affixed to diametrically-opposite edges of the hemmed peripheral border 124, in the manner shown in FIG. 20. Provided on the band 130 are a plurality of button elements 132 on one half of the band 130, and a plurality of button elements 134 on the other half of the band 130. The button elements 132 are sewn onto the outer surface of the band 130, facing away from the undersurface of the mattress over which it extends. The button elements 132 are spaced apart from each other and substantially lie in the same horizontal plane when the cover is mounted to a mattress. The button elements 134 are similar to the button elements 132 and are of the same construction, as clearly shown in FIG. 20. The hemmed peripheral border 124 is also provided with a pair of elastic loops 150, 152 for receiving therein one of the respective button elements 132, 134, in order to adjust the tension of the band 130 to a desired state to vary the holding force of the band thereof. Referring to FIG. 20, it may be seen that the second button element of the button elements 134 is positioned through the loop 152, in order to increase the tensioning force thereof to hold the cover 122 snugly and more firmly in place along the intermediate portion 146 of the cover 122. Any one of the three button elements 134 may be looped through the loop 152 and, obviously, any one of the button elements 132 may be looped through the loop 150, to arrive at a suitable tensioning force of the band 130 to hold and securely position the intermediate portion 146 of the cover 122.

The kangaroo-type pouch 177 may be used exactly in the same manner as the pouch 77 of the embodiment of FIG. 1, and may be positioned either interiorly of the mattress, in the manner shown in FIG. 16, or exteriorly thereof in the manner shown in FIG. 19. It is noted that the pocket 177, when positioned in its exterior portion, as shown in FIG. 18, will be visible since the pocket 177 extends substantially outward of the portion 156, which portion 156 is substantially defined by the upper portion of the peripheral section of the cover, incorporating therein the peripheral elastic band for retaining the entire cover in place on the mattress. A hook and pile fastener 170 is also provided on the upper, inner surface portions of the pocket 177 to provide a reclosable opening. The cover or towel 122 may be formed from one continuous piece of fabric.

While a specific embodiment of the invention has been shown and described, it is to be understood that numerous changes and modifications thereof may be made without departing from the scope, spirit and intent of the invention, as set out in the appended claims.

What is claimed is:

1. A cover for covering a lawn chair, sand chair, and the like, comprising:

an elongated main body portion for resting upon the chair for the covering thereof, said elongated main body portion comprising a first lower end portion for covering the lower portions of the chair, a second intermediate portion for covering the intermediate portions of the chair, and a third upper head portion for covering the upper head portion of the chair;

hood means comprising a rear surface layer connected along at least two sides thereof to said head portion and disconnected along one side thereof, said one side thereof extending substantially perpendicular to the length of said elongated main body portion, whereby the upper rim of the chair to be covered may be inserted through the space between said one side thereof of said rear surface layer and said head portion;

said hood means further comprising pocket means defining a pocket therein for the storage of articles, said pocket means comprising a first upper edge fixedly connected to the upper edge of said rear surface layer, and a second upper edge fixedly connected to the upper edge of said third head portion, whereby said pocket is situated between said third head portion and said rear surface layer;

said upper edge of said head portion and said upper edge of said rear surface layer being at least partially disconnected along the length thereof so as to define an opening for said pocket means defined between said first and second upper edges of said pocket means, said pocket means being suspended between said rear surface layer and said head portion such that it is positionable in one of two states relative to a chair to which it is connected, the first state thereof being against the interior surface of the back portion of the chair, and the second state thereof being exterior of the exterior surface of the back portion of the chair, wherein in the first state thereof said pocket may be stuffed with soft articles such as clothing in order to provide a pillow-like structure against which a person may rest his head.

2. The cover according to claim 1, wherein said hood means further comprises a pair of stretchable side surfaces interconnecting the oppositely disposed respective side edge surfaces of said third head portion and said rear surface layer, said pair of stretchable side surfaces allowing for the conformity of said head portion and said hood means to any size and type of chair.

3. The cover according to claim 2, wherein each of said pair of stretchable side surfaces is made of stretchable nylon fabric, which allows for the adjustability and separation of said third head portion and said rear surface layer relative to each other to accommodate various thicknesses and sizes of chairs to be covered.

4. The cover according to claim 2, wherein said hood means further comprises a pair of oppositely disposed side pockets, each said side pocket being connected to a respective said stretchable side surface, each said side pocket comprising a reclosable opening for allowing reclosing of the respective pocket for storing and removing articles therein.

5. The cover according to claim 4, wherein said cover is used for covering a sand chair or the like, and said intermediate portion of said elongated main body portion comprises a first pair of oppositely-disposed loop portions, and a second pair of oppositely-disposed loop portions;

said first pair of loop portions being integrally connected to the edges of said second intermediate portion of said substantially elongated main body portion, one said loop portion of said first pair of loop portions being integrally connected to one said side edge of said intermediate portion, and the other of said first pair of loop portion being integrally connected to the other said side edge of said intermediate portions.

6. The cover according to claim 5, wherein said second pair of loop portions comprises a first loop integrally connected to said one side edge of said intermediate portion, and a second loop integrally connected to said second side edge; said second pair of loop portion being positioned away from said first pair of loop portion in a direction toward said first lower end portions of said elongated main body portions.

7. The cover according to claim 6, wherein said cover is made of terry cloth material.

8. The cover according to claim 6, in combination with a sand chair, said sand chair having a substantially vertical backrest portion, a substantially horizontal seat portion, and frame means for mounting said backrest portion and said seat portion;

said frame means comprising a pair of armrest members upon which the person using the chair may rest his arms, said frame means further comprising vertically oriented means to which are connected rearward portions of said pair of armrest members;

each of said armrest members comprising a rearward-most portion extending rearwardly beyond the corresponding portions of said vertically-oriented means;

said first pair of loop portions of said intermediate portion of said main elongated main body portion encircling said rearward-most portions of said pair of armrest members for holding said intermediate portion of said main body portion in place.

9. The cover according to claim 8, wherein said frame means further comprises a lower frame portion comprising a lower transverse tubular member extending the entire width of the chair, said transverse tubular member having a pair of opposite end portions respectively projecting laterally outward beyond said vertically-oriented means, said end portions of said transverse tubular member receiving thereabout said second pair of loop portions to further aid in the retainment of said intermediate portion of said elongated main body portion of the cover.

10. The cover according to claim 1, wherein said first lower portion of said elongated main body portion further comprises a pair of retaining means for retaining the end of said elongated main body portion to a lower portion of the chair; each of said pair of retaining means comprising a strap means having a first end fixedly attached to said lower portion of said elongated main body portion, and a second free end; said lower portion of said elongated main body portion further comprising a cooperating securing means attached adjacent said first end of the respective said strap means and spaced therefrom on the undersurface of said lower portion of said elongated main body portion, whereby said second free end of the respective said strap means may be secured to the respective said securing means after said strap means has been wrapped about a respective portion of a chair.

11. The cover according to claim 1, wherein said cover is used for covering a lounge chair, at least one of said portions of said elongated main body portion comprising a stretchable, elastic retaining band means extending substantially the width of said main elongated portion, said band means having a first end fixedly secured to the undersurface of said main elongated portion adjacent one respective side edge surface thereof, and a second end fixedly secured to the undersurface of said main elongated portion adjacent the other of said respective side edge surface therof;

said stretchable band means comprising a first pair of button elements, and a second pair of button elements, said first pair of button elements being fixedly connected to said band means adjacent the first end thereof, and said second pair of button elements being secured adjacent said second end thereof;

each button element of each said pair of button elements being spaced from the other said button elements of the respective said pair of button elements to define a space therebetween;

said main elongated portion further comprising a pair of loop means fixedly connected to said side edges of said main elongated portion, one said loop means for one said side edge;

each said loop means receiving therein a chosen one of said button elements of the respective said pair of button elements, in order to vary the tension and holding force of said band means when said band means is positioned under the undersurface of the mattress of the lounge chair;

each said loop means extending downwardly from the respective side edges thereof to allow access thereto by a respective said button element.

12. The cover according to claim 11, wherein said stretchable band means and each of said loop means are fixedly connected to said intermediate portion of said elongated main body portion of said cover.

13. The cover according to claim 12, wherein said main body portion further comprises a hemmed peripheral border surrounding said cover, and an elastic means formed in said hemmed peripheral border extending completely around the circumference of said cover to cause the cover to fit snugly about a mattress of a lounge chair to prevent longitudinal slippage of said cover relative to the mattress.

14. The cover according to claim 1, wherein said pocket means comprises reclosable means for releasably holding together said first and second upper edges of said pocket means.

15. A method of providing a cover to a sand chair or lounge chair, which cover includes a substantially elongated main body portion, which elongated main body portion includes an upper head portion against which the head of a user of the chair to be covered rests, said upper head portion of the cover comprising a kangaroo-type pocket in which may be stored articles, said method comprising:

positioning said cover over a sand chair or lounge chair and retaining said cover thereon;

positioning the kangaroo-type pocket in the head portion of the cover such that it is positioned against the interior surface of the head of the chair;

opening the kangaroo-type pocket and inserting therein soft articles, such as clothing or the like, in order to provide a soft headrest;

removing the clothing from the kangaroo-type pocket, and positioning the kangaroo-type pocket exteriorly of the exterior surface of the head of the chair such that the kangaroo-type pocket hangs downwardly adjacent the back of the chair, where the kangaroo-type pocket is not capable of being used as a headrest or pillow.

16. The method according to claim 14, further comprising opening said kangaroo-type pocket when in its position against the exterior of the chair, and placing therein articles to be stored in the kangaroo-type pocket.

* * * * *